US008557506B2

(12) United States Patent
Fiaccabrino

(10) Patent No.: US 8,557,506 B2
(45) Date of Patent: Oct. 15, 2013

(54) METHOD OF FABRICATING A METALLIC MICROSTRUCTURE AND MICROSTRUCTURE OBTAINED VIA THE METHOD

(75) Inventor: Jean-Charles Fiaccabrino, Grandevent (CH)

(73) Assignee: Nivarox-FAR S.A., Le Locle (CH)

( * ) Notice: Subject to any disclaimer, the term of this patent is extended or adjusted under 35 U.S.C. 154(b) by 136 days.

(21) Appl. No.: 12/811,356

(22) PCT Filed: Dec. 19, 2008

(86) PCT No.: PCT/EP2008/067969
§ 371 (c)(1),
(2), (4) Date: Oct. 4, 2010

(87) PCT Pub. No.: WO2009/083488
PCT Pub. Date: Jul. 9, 2009

(65) Prior Publication Data

US 2011/0020754 A1 Jan. 27, 2011

(30) Foreign Application Priority Data

Dec. 31, 2007 (CH) ..... 2036/07

(51) Int. Cl.
*G03F 7/26* (2006.01)

(52) U.S. Cl.
USPC ..... 430/314

(58) Field of Classification Search
USPC ..... 430/311, 314, 315
See application file for complete search history.

(56) References Cited

U.S. PATENT DOCUMENTS

| | | | | |
|---|---|---|---|---|
| 4,058,401 | A | 11/1977 | Crivello | |
| 6,136,513 | A * | 10/2000 | Angelopoulos et al. | 430/315 |
| 2009/0081476 | A1 * | 3/2009 | Saucy | 428/614 |

FOREIGN PATENT DOCUMENTS

| | | | |
|---|---|---|---|
| EP | 0 567 332 | A2 | 10/1993 |
| EP | 1 596 259 | A1 | 11/2005 |
| EP | 1 835 050 | A1 | 9/2007 |
| EP | 1 835 339 | A1 | 9/2007 |
| JP | 57-171682 | A | 10/1982 |
| WO | 03/095712 | A2 | 11/2003 |

OTHER PUBLICATIONS

A. B. Frazier et al., "Metallic Microstructures Fabricated Using Photosensitive Polyimide Electroplating Molds", Journal of Microelectromechanical Systems, vol. 2, No. 2 Jun. 1993, pp. 87-94.
International Search Report issued in corresponding application No. PCT/EP2008/067969, completed May 11, 2009 and mailed May 19, 2009.
Di Bari G.A. "electroforming" Electroplating Handbook 4th Edition by L. J. Durney, published by Van Nostrand Reinhold Company Inc., N.Y. USA 1984.
András Baczoni et al., Advanced Examination of Zinc Rich Primers with Thermodielectric Spectroscopy, 8 Acta Polytechnica Hungarica 43-51 (2011), filed herewith as Exhibit A.
Letter reporting Notice of Reasons for Refusal in corresponding Japanese application 2010/540105 reported to Applicant on May 16, 2013.

* cited by examiner

*Primary Examiner* — Kathleen Duda
*Assistant Examiner* — Caleen Sullivan
(74) *Attorney, Agent, or Firm* — Griffin & Szipl, P.C.

(57) ABSTRACT

The invention concerns a method of fabricating a metallic microstructure, characterized in that it includes the steps consisting in forming a photosensitive resin mold by a LIGA-UV type process, and in the uniform, galvanic deposition of a layer of a first metal and then a layer of a second metal form a block, which approximately reaches the top surface of the photosensitive resin.

12 Claims, 1 Drawing Sheet

METHOD OF FABRICATING A METALLIC MICROSTRUCTURE AND MICROSTRUCTURE OBTAINED VIA THE METHOD

This is a National Phase Application in the United States of International Patent Application PCT/EP2008/067969 filed Dec. 19, 2008, which claims priority on Swiss Patent Application No. 02036/07, filed Dec. 31, 2007. The entire disclosures of the above patent applications are hereby incorporated by reference.

FIELD OF THE INVENTION

The present invention concerns a method of fabricating a metallic microstructure via a LIGA type technology. In particular, the invention concerns a method of this type for fabricating a microstructure, which has a core made of a first metal, at least partially coated with a functional layer, of a second metal and wherein the precision of the geometrical dimensions are directly defined by the method. The invention also concerns a metal part of this type obtained via this method.

BACKGROUND OF THE INVENTION

LIGA technology (Lithographie Galvanik Abformung), developed by W. Ehrfeld of the Karlsruhe Nuclear Research Centre, Germany in the 1980s, has proved advantageous for fabricating high precision metallic microstructures.

The principle of LIGA technology consists in depositing, on a conductive substrate or substrate coated with a conductive layer, a photosensitive resin layer, in performing X ray radiation through a mask that matches the contour of the desired microstructure using a synchrotron, developing i.e. removing the non-radiated portions of the photosensitive resin layer by physical or chemical means, to define a mould that has the contour of the microstructure, in galvanically depositing a metal, typically nickel, in the photosensitive resin mould, then removing the mould to release the microstructure.

The quality of the microstructures obtained is not open to criticism, but the requirement to implement expensive equipment (the synchrotron) makes this technique incompatible with the mass production of microstructures that have to have a low unitary cost.

This is why, on the basis of this LIGA method, similar methods have been developed, but which use UV photosensitive resins. A method of this type is disclosed, for example, in the publication by A. B. Frazier et al., entitled "Metallic Microstructures Fabricated Using Photosensitive Polyimide Electroplating Molds", Journal of Microelectromechanical Systems, Vol. 2, N deg. 2 Jun. 1993, for fabricating metallic structures by electroplating metal in polyimide based photosensitive moulds. This method includes the following steps:

- creating a sacrificial metallic layer and a conductive priming layer for a subsequent electrodeposition step;
- applying a photosensitive polyimide layer;
- UV irradiating the polyimide layer through a mask that matches the contour of the desired microstructure;
- developing, by dissolving, the non-irradiated parts of the polyimide layer so as to obtain a polyimide mould;
- galvanically depositing nickel in the open part of the mould up to the height of the mould, and
- removing the sacrificial layer and separating the metallic structure obtained from the substrate, and
- removing the polyimide mould.

The microstructures obtained in accordance with the methods of the prior art are metallic microstructures made of a single metal, generally nickel, and copper, nickel-phosphorus, which is not always optimal depending upon the application for which they are intended. Indeed, applications exist for which one or other of these materials does not have optimal properties, both from the mechanical and tribological point of view. Typically, a toothed wheel has to be sufficiently rigid to resist breakage if subjected to a high level of stress, but also has to have teeth with a low friction coefficient to facilitate gearing. The choice of nickel is thus very advantageous from the point of view of mechanical resistance, however nickel has less advantageous tribological properties, since it has a relatively high friction coefficient.

One way of solving this problem consists in making the core of the desired microstructure by a LIGA-UV method with a first metal, then coating the core with a layer of a second metal by another, conventional method, for example, by vacuum vapour deposition. This type of method has, however, the drawback of not allowing parts to be obtained simply with controlled geometrical precision. There therefore exists a need for a method that can overcome this drawback.

SUMMARY OF THE INVENTION

It is an object of the invention to overcome the aforementioned drawbacks in addition to others by providing a method for fabricating microstructures that are optimally adapted, from the point of view of their composition, to the application for which they are intended. The microstructures thereby obtained have geometrical dimensions whose precision is controlled.

It is also an object of the present invention to provide a method of this type, which can fabricate microstructures that have a core made of a first metal, coated with a layer of a second metal, and wherein the precision of the desired geometrical dimensions is defined by the method.

It is also an object of the present invention to provide a method of this type, which is simple and inexpensive to implement.

The invention therefore concerns a method of fabricating a metallic microstructure including the following steps:

a) taking a substrate, which has at least one conductive surface;

b) applying a photosensitive resin layer to the conductive surface of the substrate;

c) irradiating the resin layer through a mask defining the contour of the desired microstructure;

d) dissolving the non-irradiated zones of the photosensitive resin layer to reveal, in places, the conductive surface of the substrate;

e) galvanically and uniformly depositing one layer of a first metal from the conductive surface of the substrate and one conductive surface of the photosensitive resin;

f) galvanically and uniformly depositing a layer of a second metal from the first metal layer to form a block that approximately reaches the level of the top surface of the photosensitive resin layer;

g) flattening the resin and the deposited metal to bring the resin and the electrodeposited block to the same level;

h) separating the resin layer and the electrodeposited block from the substrate by delamination;

i) removing the photosensitive resin layer from the delaminated structure to release the microstructure thereby formed.

This method thus makes finished parts that have a core made of a first metal, coated with a layer of a second metal, and wherein the desired precision of the geometrical dimensions is defined by the dimensions of the photosensitive resin mould in which the galvanic depositions of the two metals take place, or, in other words, by the precision of the photolithographic technique used. Careful selection of the two metals forming the microstructure enables the mechanical properties of the part to be best adapted to a given application. For example, if a toothed wheel is made, the first metal could be deposited in the form of a fine layer, typically a layer of nickel-phosphorous of several dozen microns, to promote a lowering in the friction coefficient of the part, and the second metal could be deposited in the form of a, typically, nickel block, the latter conferring the part with mechanical resistance.

According to a preferred embodiment of the invention, the first and metals have different mechanical properties in order to form a microstructure whose mechanical properties are optimised. The first metal preferably has a lower friction coefficient than the second metal, and the second metal has a higher level of mechanical resistance than the first metal. The first metal is, for example, a nickel-phosphorous alloy and the second metal is, for example, nickel.

Typically, the conductive surface of the substrate is formed of a stack of chromium and gold layers and the conductive surface of the photosensitive resin layer is formed by activating the resin.

This method can makes several micromechanical structures on the same substrate.

According to another embodiment of the invention, the method further includes, prior to step h), a step of depositing a conductive, priming layer and a repetition of steps b) to g) with a second mask defining a second contour for a second level of the microstructure, for example to make a toothed wheel, which has two toothings of different diameters.

The method of the invention is of particularly advantageous application for fabricating micromechanical parts for timepiece movements. In particular, the parts could be chosen from among the group comprising toothed wheels, escape wheels, levers, pivoting parts, jumper springs, balance-springs, cams and passive parts.

Thus, generally, the present invention pertains broadly to a method of fabricating a metallic microstructure, characterized in that it includes the steps consisting in forming a photosensitive resin mould by a LIGA-UV type process, and in the uniform, galvanic deposition of a layer of a first metal and then a layer of a second metal form a block, which approximately reaches the top surface of the photosensitive resin.

BRIEF DESCRIPTION OF THE DRAWINGS

Other features and advantages of the present invention will appear more clearly from the following detailed description of an example embodiment of a method according to the invention, this example being given purely by way of illustration, in conjunction with the annexed drawing, in which.

DETAILED DESCRIPTION OF THE ILLUSTRATIVE EMBODIMENTS

Figure 1:
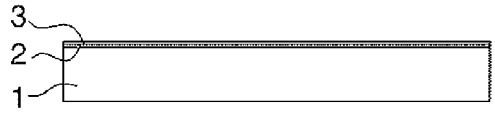
FIGS. 1 to 8 illustrate the steps of the method of one embodiment of the invention for making a toothed wheel.
Figure 2:
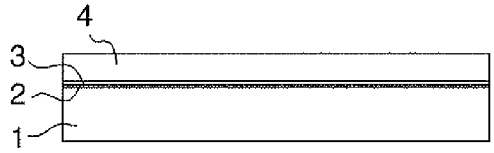

Substrate 1 used in step a) of the method according to the invention is, for example, formed by a silicon, glass or ceramic wafer on which a conductive priming layer is evaporation deposited, i.e. a layer able to trigger an electroforming reaction. The conductive, priming layer is typically formed of a chromium sub-layer 2 and a gold layer 3 (FIG. 1).

Alternatively, the substrate 1 could be formed of stainless steel or another metal able to trigger the electroforming reaction. In the case of a stainless steel substrate, the substrate will be cleaned first.

The photosensitive resin 4 used in step b) of the method according to the invention is preferably an octofunctional epoxy resin available from Shell Chemical under the reference SU-8 and a photoinitiator selected from among triarylsulfonium salts, such as those described in U.S. Pat. No. 4,058,401. This resin can be photopolymerised under the action of UV radiation. It will be noted that a solvent that has proved suitable for this resin is gammabutyrolactone (GBL).

Alternatively, a Novolac-type phenol formaldehyde-based resin, in the presence of a DNQ (DiazoNaphtoQuinone) photoinitiator, could also be used.

Resin 4 is deposited on substrate 1 by any suitable means, for example using a spin coater, until the desired thickness is attained. Typically, the thickness of the resin is comprised between 150 μm and 1 mm. Depending upon the desired thickness and the deposition technique used, resin 4 will be deposited in one or several goes.

Resin 4 is then heated between 90 and 95° C. for a period of time that depends upon the deposited thickness, to remove the solvent.

Figure 3:
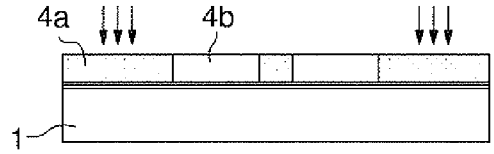

The next step c), illustrated in FIG. 3, consists in irradiating the resin layer 4 by means of UV radiation through a mask that defines the contour of the desired microstructure M and also insulated zones 4*a* and non-insulated zones 4*b*. This UV radiation is typically from 200 to 1,000 $mJ \cdot cm^{-2}$, measured along a wavelength of 365 nm, depending upon the thickness of the layer. If required, an annealing step may be necessary for the layer to complete the photo-polymerisation induced by UV radiation. This annealing step is preferably performed between 90° C. and 95° C. for 15 to 30 minutes. The insulated (photopolymerised) zones 4*a* become insensitive to the vast majority of solvents. However, a solvent could subsequently dissolve the non-insulated zones.

Figure 4:
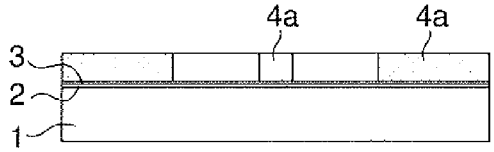

The next step d), illustrated in FIG. 4, consists in developing the non-insulated zones 4*b* of the photosensitive resin layer to reveal, in places, the conductive layer 3 of substrate 1. This operation is performed by dissolving non-insulated zones 4*b* by means of a solvent selected from among GBL (gammabutyrolactone) and PGMEA (propylene glycol methyl ethyl acetate). An insulated photosensitive resin mould 4*a*, with the contours of a metallic structure, is thus made.

Figure 5:
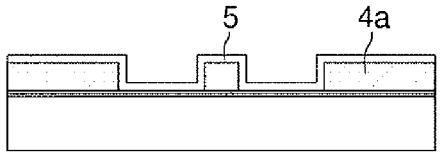

The next step e), illustrated in FIG. 5, consists of the galvanic deposition of a layer 5 of a first metal, in the mould, from the conductive layer 3, taking care that first layer only extends over part of the depth of the mould and also along the vertical walls of the mould. In order to do this, the resin layer 4 forming the mould has either been activated to make it conductive, or been coated with a conductive priming layer. The thickness of layer 5 of this first metal matches the thickness of the cladding of the microstructure that one wishes to obtain. Typically, the thickness of this layer could be comprised between several microns and several dozen microns.

Figure 6:
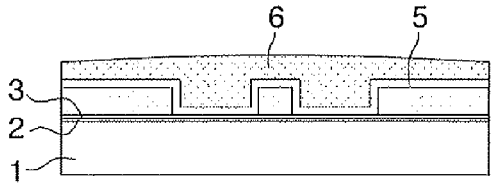

The next step f), illustrated in FIG. 6, consists of the galvanic deposition, in the mould coated with layer 5, of a layer 6 of a second metal, different from the first, to form a block that approximately reaches the top surface of photosensitive resin 4*a*, the block being formed of layer 5 of the first metal and layer 6 of the second metal. In this context, "metal" naturally includes metal alloys. Typically, the first and second metals will be chosen from among the group including nickel, copper, gold or silver, and, as alloy, gold-copper, nickel-cobalt, nickel-iron and nickel-phosphorous.

The thickness of layer 6 of the second metal can vary depending upon the desired use of microstructure M. Typically, the thickness of layer 6 of the second metal can vary between 100 microns and 1 mm. In a particular application, such as a cam or a pinion, one could, for example, make a microstructure that includes a layer 5 with good tribological qualities, typically made of nickel-phosphorous, and a layer 6 of a second metal that is mechanically resistant, typically nickel.

The electroforming conditions, particularly the composition of the baths, the system geometry, voltages and current densities, for each metal or alloy to be electrodeposited, are selected in accordance with well known techniques in the electroforming field (cf, for example Di Bari G. A. "electroforming" Electroplating Handbook 4$^{th}$ Edition by L. J. Durney, published by Van Nostrand Reinhold Company Inc., N.Y. USA 1984).

Figure 7:
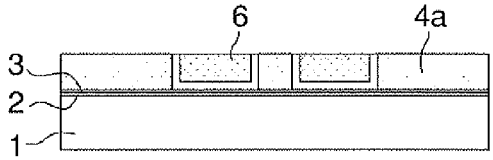

In the next step g), illustrated in FIG. 7, the electroformed block is made level with the resin layer. This step can occur by abrasion and polishing in order to provide immediately microstructures that have a flat top surface, with a surface state rugosity compatible with the requirements of the watch industry for making a top of the range movement.

Figure 8:
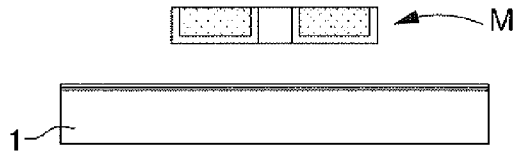

The next step h), illustrated in FIG. 8, consists in separating the resin layer and the electrodeposited block from the substrate by delamination. Once the delamination operation has been performed, the photosensitive resin layer is removed from the delaminated structure to release the microstructure M thereby formed. In order to do this, the photopolymerised resin is dissolved, in step i), by N-methyl-2-pyrrolidone (NMP), or the resin could be removed by a plasma etch.

The microstructure thus released can then either be used immediately or, as required, after suitable machining. It is clear that, because of the geometrical precision of resin mould 4, microstructure M, illustrated in FIG. 8, includes a core formed from the second metal layer 6 and a very precise cladding formed from first metal layer 5. Thus, as illustrated in FIG. 8, one can obtain a microstructure whose external, internal and bottom walls are coated with first metal layer 5.

Thus, as explained above, it is clear that, if first metal layer 5 has good tribological qualities, these walls can advantageously act as a contact surface in the aforecited applications such as a cam or a pinion.

In accordance, then, more generally in accordance with a first non-limiting illustrative embodiment of the present invention, a method of fabricating a metallic microstructure (M) is characterized in that it includes the following steps of: (a) taking a substrate (1), which has at least one (3) conductive surface; (b) applying a photosensitive resin layer (4) onto the conductive surface (3) of the substrate (1); (c) irradiating the resin layer (4) through a mask defining the contour (4*a*) of the desired microstructure; (d)

dissolving the non-irradiated zones (4*b*) of the photosensitive resin layer (4) to reveal, in places, the conductive surface (3) of the substrate (1); (e) galvanically and uniformly depositing a layer of a first metal (5) from the conductive surface (3) of the substrate (1) and a conductive surface of the photosensitive resin (4*a*); (f) galvanically and uniformly depositing a layer (6) of a second metal from the first metal layer to form a block that approximately reaches the level of the top surface of the photosensitive resin layer (4); (g) flattening the resin (4) and the deposited metal (5, 6) to bring the resin and the electrodeposited block to the same level; (h) separating, by delamination, the resin layer (4) and the electrodeposited block from the substrate (1); and (i) removing the photosensitive resin layer (4) from the delaminated structure to release the microstructure (M) thereby formed. In accordance with a second non-limiting, illustrative embodiment of the present invention, the first illustrative embodiment is modified so that the first and second metals have different mechanical properties so as to form a microstructure (M) whose mechanical properties are optimised.

In accordance with a third non-limiting illustrative embodiment of the present invention, the first and second non-limiting embodiments are modified so that the first metal has a lower friction coefficient than the second metal and in that the second metal has a higher level of mechanical resistance than the first metal. In accordance with a fourth non-limiting illustrative embodiment of the present invention, the first, second and third non-limiting embodiments are further modified so that the first metal is a nickel-phosphorous alloy and the at least one second metal is nickel.

In accordance with a fifth non-limiting illustrative embodiment of the present invention, the first, second, third and fourth non-limiting embodiments are further modified so that the conductive surface (3) of the substrate (1) is formed of a stack of chromium (2) and gold (3) layers. In accordance with a sixth non-limiting illustrative embodiment of the present invention, the first, second, third, fourth, and fifth illustrative embodiments are further modified so that the conductive surface (3) of the photosensitive resin layer (4*a*) is formed by activating the resin. In accordance with a seventh non-limiting illustrative embodiment of the present invention, the first, second, third, fourth, fifth and sixth non-limiting illustrative embodiments are further modified in that several micromechanical structures are fabricated on the same substrate.

In accordance with an eighth non-limiting illustrative embodiment of the present invention, a metallic microstructure is provided, which is obtained in accordance with any of the methods in accordance with the first, second, third, fourth, fifth, sixth and seventh illustrative embodiments, characterized in that the metallic microstructure forms a micromechanical part for a timepiece movement and is, in particular, selected from among the group formed of toothed wheels, escape wheels, levers, pivoting parts, jumper springs, balance springs and passive parts or cams.

The invention claimed is:

1. A method of fabricating a bimetallic microstructure, wherein the method includes the following steps:

(a) providing a substrate that has at least one conductive surface;

(b) applying a photosensitive resin layer onto the at least one conductive surface of the substrate;

(c) irradiating the photosensitive resin layer through a mask defining a contour of a predefined microstructure;

(d) dissolving non-irradiated zones of the photosensitive resin layer to reveal, in places, the at least one conductive surface of the substrate;

(e) rendering irradiated zones of the photosensitive resin layer electrically conductive so as to form with the at least one conductive surface a substrate top surface of a mould, wherein the entire substrate top surface is electrically conductive;

(f) galvanically and uniformly depositing a first metal layer of a first metal on the at least one conductive surface of the substrate and on electrically conductive surfaces of the photosensitive resin layer;

(g) galvanically and uniformly depositing a second metal layer of a second metal on the first metal layer to form an electrodeposited block that approximately reaches a level of a top surface of the photosensitive resin layer;

(h) flattening the photosensitive resin layer and deposited first metal and second metal to bring the photosensitive resin layer and the electrodeposited block to the same level;

(i) separating, by delamination, the photosensitive resin layer and the electrodeposited block from the substrate; and (j) removing the photosensitive resin layer from the delaminated structure to release the bimetallic microstructure thereby formed.

2. The method according to claim 1, wherein the first metal and the second metal are different metals so as to form a microstructure whose mechanical properties are optimised by the different metals.

3. The method according to claim 1, wherein the first metal has a lower friction coefficient than the second metal and wherein the second metal has a higher level of mechanical resistance than the first metal.

4. The method according to claim 1, wherein the first metal is a nickel-phosphorous alloy and the second metal is nickel.

5. The method according to claim 1, wherein said at least one conductive surface of the substrate comprises a stack of chromium and gold layers.

6. The method according to claim 1, wherein said electrically conductive irradiated zones of the photosensitive resin layer are formed by activating resin of the photosensitive resin layer.

7. The method according to claim 1, wherein said electrically conductive irradiated zones of the photosensitive resin layer are formed by coating a conductive priming layer on the photosensitive resin layer.

8. The method according to claim 1, wherein several micromechanical structures are fabricated on the same substrate provided in step (a).

9. The method according to claim 1, wherein the bimetallic microstructure is a micromechanical part of a timepiece.

10. The method according to claim 1, wherein, in step (h) the photosensitive resin layer, the deposited first metal and the deposited second metal are flattened by abrasion and polishing to provide a flat top surface including a first portion consisting of the photosensitive resin layer, a second portion consisting of the deposited first metal and a third portion consisting of the second deposited metal.

11. A method of fabricating a bimetallic microstructure, wherein the method includes the following steps:

(a) providing a substrate that has at least one conductive surface;

(b) applying a photosensitive resin layer onto the at least one conductive surface of the substrate;

(c) irradiating the photosensitive resin layer through a mask defining a contour of a predefined microstructure;

(d) dissolving non-irradiated zones of the photosensitive resin layer to reveal, in places, the at least one conductive surface of the substrate;

(e) rendering irradiated zones of the photosensitive resin layer electrically conductive so as to form with the at least one conductive surface a substrate top surface of a mould, wherein the entire substrate top surface is electrically conductive, and wherein the irradiated zones of the photosensitive resin layer are rendered electrically conductive by activating the photosensitive resin layer so the photosensitive resin layer is conductive, or by coating the photosensitive resin layer with a conductive priming layer;

(f) galvanically and uniformly depositing a first metal layer of a first metal on the at least one conductive surface of the substrate and on electrically conductive surfaces of the photosensitive resin layer;

(g) galvanically and uniformly depositing a second metal layer of a second metal on the first metal layer to form an electrodeposited block that approximately reaches a level of a top surface of the photosensitive resin layer;

(h) flattening the photosensitive resin layer and deposited first metal and second metal to bring the photosensitive resin layer and the electrodeposited block to the same level;

(i) separating, by delamination, the photosensitive resin layer and the electrodeposited block from the substrate; and (j) removing the photosensitive resin layer from the delaminated structure to release the bimetallic microstructure thereby formed.

12. The method according to claim 11, wherein, in step (h) the photosensitive resin layer, the deposited first metal and the deposited second metal are flattened by abrasion and polishing to provide a flat top surface including a first portion consisting of the photosensitive resin layer, a second portion consisting of the deposited first metal and a third portion consisting of the second deposited metal.

* * * * *